United States Patent [19]

Miller

[11] 4,166,587

[45] Sep. 4, 1979

[54] METHOD AND APARATUS FOR TRANSFERRING YARN ON A NEARLY FULL PACKAGE TO AN EMPTY BOBBIN

[75] Inventor: Harry B. Miller, Charlotte, N.C.

[73] Assignee: Industrie-Werke Karlsruhe Augsburg Aktiengesellschaft, Fed. Rep. of Germany

[21] Appl. No.: 911,777

[22] Filed: Jun. 1, 1978

[51] Int. Cl.[2] ..... B65H 54/02; B65H 67/04

[52] U.S. Cl. ..... 242/18 A; 242/18 PW; 242/19

[58] Field of Search ..... 242/18 A, 18 PW, 25 A, 242/18 DD, 19

[56] References Cited

U.S. PATENT DOCUMENTS

| | | | |
|---|---|---|---|
| 3,149,795 | 9/1964 | Rhein, Jr. | 242/18 A |
| 3,310,247 | 3/1967 | Emery | 242/18 A |
| 3,550,871 | 12/1970 | Keith | 242/18 A |
| 3,625,442 | 12/1971 | DiMeglio | 242/18 A |
| 3,628,741 | 12/1971 | Enneking et al. | 242/18 A X |
| 3,697,007 | 10/1972 | Taylor et al. | 242/18 A X |
| 3,717,310 | 2/1973 | Ritter | 242/18 A |
| 3,758,042 | 9/1973 | Sear | 242/18 A |
| 3,857,522 | 12/1974 | Fink | 242/18 A |
| 3,876,161 | 4/1975 | Miller | 242/18 A |

*Primary Examiner*—Stanley N. Gilreath
*Attorney, Agent, or Firm*—McGlew and Tuttle

[57] ABSTRACT

The yarn to be transferred is fed at high speed through a traverse mechanism and between a drive roll and a bobbin mounted on a first chuck and rotated by the drive roll to cross-wind a yarn package. An empty bobbin is mounted on a second chuck parallel to the first chuck. When the package is substantially full wound, the empty bobbin is engaged with the drive roll and the yarn package is retracted to provide a clearance space between the package and the drive roll. A transfer rod on the free end of an arm pivoted on the traverse mechanism, and extending parallel to the drive roll, is swung through the clearance space to engage the yarn and draw a loop to toward the rotating empty bobbin, and the package is then reengaged by the drive roll for continued high speed rotation to maintain tension on the drawn loop while the transfer rod draws the yarn loop against and beyond the empty bobbin. A yarn pickup and transfer device disengages the fed yarn from the traverse mechanism and moves the yarn axially of the transfer rod and into a slot therein aligned with the starting end of the empty bobbin, for catching and severing of the yarn by a hook with the yarn clamped to the second chuck. The full package is retracted from the drive roll and the transfer rod is swung back into its inactive position, with the pickup and transfer device effecting reengagement of the yarn in the traverse mechanism for cross-winding on the empty chuck. The pivoted arms are operated by rotary actuators and the transfer rods engage respective stops at the ends of their yarn drawing movements. The pickup and transfer device is operated by a fluid pressure linear actuator but may be operated by an electric stepping motor supplied by an adjustable inverter, and such an arrangement may also be used to swing the transfer rods. The chucks may be rotated by fluid pressure operated turbines.

21 Claims, 16 Drawing Figures

METHOD AND APARATUS FOR TRANSFERRING YARN ON A NEARLY FULL PACKAGE TO AN EMPTY BOBBIN

CROSS-REFERENCE TO RELATED APPLICATION

The method and apparatus of the present invention are an improvement on the mechanism and method of copending application Ser. No. 809,676, filed June 24, 1977.

FIELD AND BACKGROUND OF THE INVENTION

This invention relates to yarn winders and a method of operating the same, and more particularly to a yarn winder provided with means for transferring yarn from a nearly fully wound package on a bobbin mounted on a first chuck to an empty bobbin mounted on a second chuck, and to a method of effecting such transfer.

As mentioned in copending application Ser. No. 809,676, modern winders, for winding yarn into yarn packages on bobbins or tubes, generally include two or more rotatable chucks, each supporting one or more bobbins or tubes. While one chuck is being rotated for winding of yarn into packages on bobbins or tubes mounted thereon, empty bobbins or tubes are placed on a second chuck then in a standby condition. When full packages have been wound on the first chuck, the latter is brought to a stop and the full packages are removed therefrom. It is then necessary for the winder operator or attendant to properly thread the yarn for winding on the bobbins or tubes on the second chuck.

The threading of the yarn is usually effected by feeding the end of the yarn into an aspirator or the like, and then using a "doffer" to engage the yarn in transverse guides for proper winding in a criss-cross manner on the bobbins or tubes. Such re-threading or re-guiding of the yarn, when full packages have been wound so that the yarn can begin to be wound on empty bobbins or tubes, requires a considerable amount of time. More important, however, is the waste involved, particularly when yarns are being fed at very high speeds. Additionally, it is difficult, with known winders, to obtain accurately sized packages as well as uniform packages.

The changeover time required for switching yarn from a full package to an empty bobbin or tube is of particularly great importance with the heavy denier yarns now being used to an increasing extent. It is important that the changeover time be kept to a minimum, an the magnitude of the changeover time is in direct relation to the amount of yarn wasted during transfer from a full package to an empty bobbin or tube. The foregoing factors are becoming of increasing importance with the development of winders using pairs of top and bottom chucks on opposite sides of a traverse housing, with each chuck accomodating two or more tubes or bobbins. While such winders increase the efficiency of the yarn winding operation, the increase in efficiency is hampered by the time required to transfer from a full bobbin or package to an empty bobbin or tube. In some of the more modern winders, used with heavier denier yarn, the speed of yarn feed is so fast that it is necessary to make a transfer from a full package to an empty bobbin or tube substantially every ten minutes. This involves relatively high labor costs due to the number of personnel required.

The problem of providing a mechanism for automatically transferring yarn from a full package to an empty bobbin or tube for winding on the latter, without manual assistance, is effectively solved by the mechanism and method of application Ser. No. 809,676. With this method and mechanism, the operation of transferring the yarn is much more accurate from the standpoint of package size and much more uniform, in addition to which the waste is reduced to a minimum, but tolerable, amount.

However, it has been found, in practice, that the mechanism and method of application Ser. No. 809,676, with respect to the yarn transfer operation, can be improved in several respects, while using the same principle but requiring fewer parts, obtaining more "wrap around" the chuck by the yarn to be transferred, a more rugged construction, and with less possibility of pneumatic actuators moving yarn transfer rods at the wrong time due to failure of pneumatic components.

For example, with the method and mechanism of application Ser. No. 809,676, it was not possible to obtain enough "wrap around" the empty bobbin at transfer, thus causing some failures in picking up and clamping of the yarn by the hook and clamp on the chuck, and to improve this operation would require more space than is available. Thus, in the apparatus of application Ser. No. 809,676, an additional cylinder and slide component would have to be added to the top chuck mechanism to attain more "wrap around" and this would increase the possiblity for pneumatic failure. Also, with the method and mechanism of application Ser. No. 809,676, there was the possiblity that a malfunction or pneumatic failure could force the extension cylinder to push the transfer rod against the drive roll with resultant possible damage to components. Some of the possible disadvantages of the method and mechanism of application Ser. No. 809,676 result from the fact that the yarn transfer rods are pivoted about the axes of the respective chucks, and also due to the fact that the nearly fully wound yarn package is not positively rotated during the transfer operation, which resulted in some loss of tension in the yarn loop being drawn by the transfer rods.

SUMMARY OF THE INVENTION

The present invention relates to yarn winders and, more particularly, to a novel and improved apparatus and method based on the same principle as the method and mechanism of application Ser. No. 809,676, and designed to automatically transfer yarn, being wound at high speed into a yarn package, from a nearly full package to an empty bobbin without reducing the yarn speed and with substantially no loss of yarn during the transfer.

In the same manner as the method and mechanism of application Ser. No. 809,676, the yarn transfer method and apparatus of the present invention are applicable to a yarn winder having pairs of chucks, with each pair including a top chuck and a bottom chuck, each adapted to have mounted thereon at least one bobbin and preferably two or more bobbins. A traverse housing and cam extends parallel to and between the pairs of chucks, and includes the usual traverse guides, each respective to a bobbin, for guiding the yarn for cross-winding yarn packages on the bobbins. Each pair of chucks is operatively associated with a respective common drive roll which effects rotation of the bobbins, or the yarn packages thereon, by direct engagement therewith, at uniform yarn speeds. Only one chuck at a time, of each pair, is in operative association with the associated drive roll, and the other chuck is in retracted or standby relation to the drive roll. In the usual manner, the chucks are laterally displaceable toward and away from the associated drive roll, both when stationary and when rotating.

In addition, either each bobbin is provided with a peripheral groove adjacent the "starting" end thereof, as shown in copending U.S. application Ser. No. 690,967, filed May 28, 1976 and now issued as U.S. Pat. No. 4,081,149, or each chuck may be provided with a peripheral groove adjacent the "starting" end of each bobbin mounted thereon, and suitable yarn catching means, such as a hook, a clasp, or the like, may be associated with each groove in the chuck. These grooves serve to "catch" yarn drawn thereinto for wrapping of a few turns of yarn on the bobbin, starting from the "starting" end of the bobbin, to form a transfer tail for use, for example, with the transfer tails mechanism shown in U.S. application Ser. No. 690,967 after which the yarn is cross-wound by the associated traverse guides.

To effect automatic transfer of the yarn being wound on a nearly full package to an empty bobbin, each chuck has operatively associated therewith a respective yarn transfer means which is rotatable about an axis parallel to but substantially spaced from the axis of the associated chuck, and the traverse housing has mounted thereon yarn pickup or pusher means, operable by suitable mehanism, to disengage the yarn, then being cross-wound on a nearly full package, from the associated traverse guide and to shift the yarn axially of the associated chuck to a point adjacent yarn catching means, such as a groove, associated with each bobbin. Each yarn transfer means includes a transfer rod, which may be cylindrical in cross-section, extending substantially the full length of the associated chuck and revolvable about a respective axis, spaced laterally from the axis of the associated chuck, such as extending centrally of the traverse housing. Each transfer rod has, for each yarn to be transferred, a slot formed therein and substantially aligned with the yarn catching groove or the like of the associated chuck. The yarn pick-up means guides the yarns into these slots in the associated transfer rod.

An important feature of the invention is the swinging of the transfer rods about axes which are spaced from the axes of the associated chucks, toward the sides of the chucks remote from the transfer rods. This feature is of the greatest importance in assuring an effective "wrap around" of the yarn with respect to the associated chucks or the bobbins mounted thereon, while not requiring any increase in the space occupied by the yarn transfer mechanism.

The method of the invention is performed, using the mechanism of the invention, in a manner which will now be described. When the winding of a full package of yarn has been substantially completed, and upon signal, the substantially full package, upon a first chuck, is moved away from the drive roll and an empty bobbin, on a second chuck, is moved into engagement with the drive roll. The yarn pickup means is moved longitudinally of the traverse housing to catch the yarn or yarns in the traverse guides and disengage these yarns therefrom, to move the yarns toward the starting end or ends of the empty bobbin or bobbins. The yarn transfer rod associated with the first chuck, on which a substantially full package is being wound, is then revolved about the pivot axis of its associated arm so as to move through the space between the drive roll and the substantially full package to draw a loop of yarn. While this loop is being drawn, the substantially full package is moved back into engagement with the drive roll so as to maintain full tension on the yarn loop being drawn. The drawing of the yarn loop continues with the transfer rod moving the yarn into engagement with and around the starting end of the second chuck or of the bobbin thereon. Meanwhile, the yarn pickup means has moved the yarn into alignment with the notch in the transfer rod and, as the empty bobbin continues to rotate at high speed, the yarn is caught by a hook on the second chuck and clamped in a groove or the like, with the yarn being severed by the hook. The substantially full yarn package is then again retracted from the drive roll and the transfer rod is swung back to its inactive or standby position, with the yarn now being wound on the empty chuck. The yarn pickup means effects release of the yarn or yarns into the transverse guides on the traverse housing for continued cross-winding of the yarn on the empty bobbin. The first chuck, mounting the substantially full yarn package which is now retracted from the drive roll, may be braked to a stop and the yarn package or packages may be removed therefrom and replaced by an empty bobbin or bobbins.

When a new package on the previously empty chuck is substantially fully wound, the same transfer operation is effected using the yarn transfer rod associated with the second chuck and continuing through the same sequence of operations.

The arms carrying the two transfer rods may be rotated by any suit able means, such as a rotary actuator. Stop means are provided at the active limit of movement of each transfer rod to be engaged by the transfer rod. The yarn pickup means are moved longitudinally of the traverse housing by suitable fluid pressure actuated devices such as, for example, a cylinder and piston. The fluid pressure actuators may be actuated by compressed air but, for more precise control of the positioning of the yarn pickup means, the fluid pressure actuators may be hydraulic actuators. Alternatively, movement of the yarn pickup means may be effected by a stepping motor supplied from a variable frequency inverter. Such a stepping motor, supplied from a variable frequency inverter, may also be used for rotating the arms carrying the transfer rods.

While it has been mentioned that the top and bottom chucks of each pair are rotated by engagement with the associated drive roll, or by engagement of packages thereon with the associated drive roll, the chucks may be independently rotated by suitable drive means whose speed is controlled in accordance with the size of the package being wound on bobbins thereon. Thus, by way of example, the chucks may be driven by separate air-operated turbines, for example. Also, each drive roll may be provided with an overdrive ring for providing even faster rotation for a chuck engaged therewith prior to engagement of the package being wound on bobbins, on such chuck, with the drive roll proper.

An object of the invention is to provide a method and apparatus for transferring yarn, being wound at high speed on a substantially full bobbin, to an empty bobbin rotated at high speed, while maintaning full tension on the yarn.

Another object is to provide such a method and apparatus by which an improved "wrap around" of the yarn on the empty bobbin is effected.

A further object of the invention is to provide such an apparatus which is simple and rugged in construction and requiring relatively few movable parts.

Yet another object of the invention is to provide such a method and apparatus which can be readily adapted for use with existing yarn winders.

For an understanding of the principles of the invention, reference is made to the following description of typical embodiments thereof as illustrated in the accompanying drawings.

DESCRIPTION OF THE PREFERRED EMBODIMENTS

Figure 1:
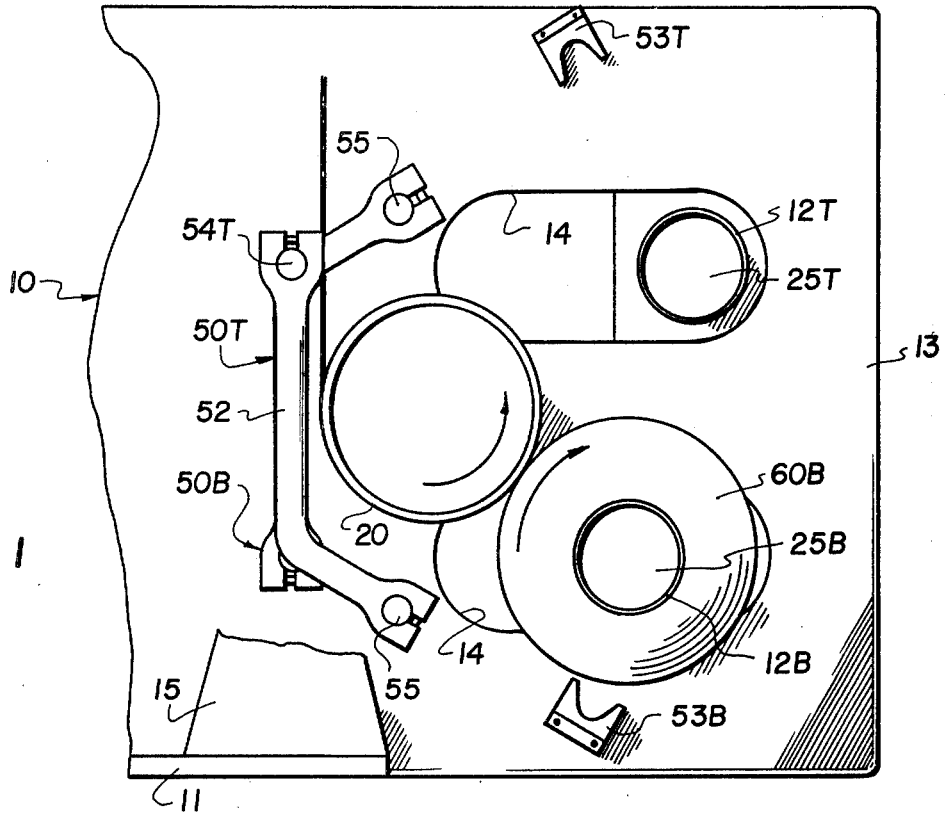
FIG. 1 is an end elevation view of a yarn winder embodying the invention illustrating a yarn package being wound on a lower chuck.
Figure 2:
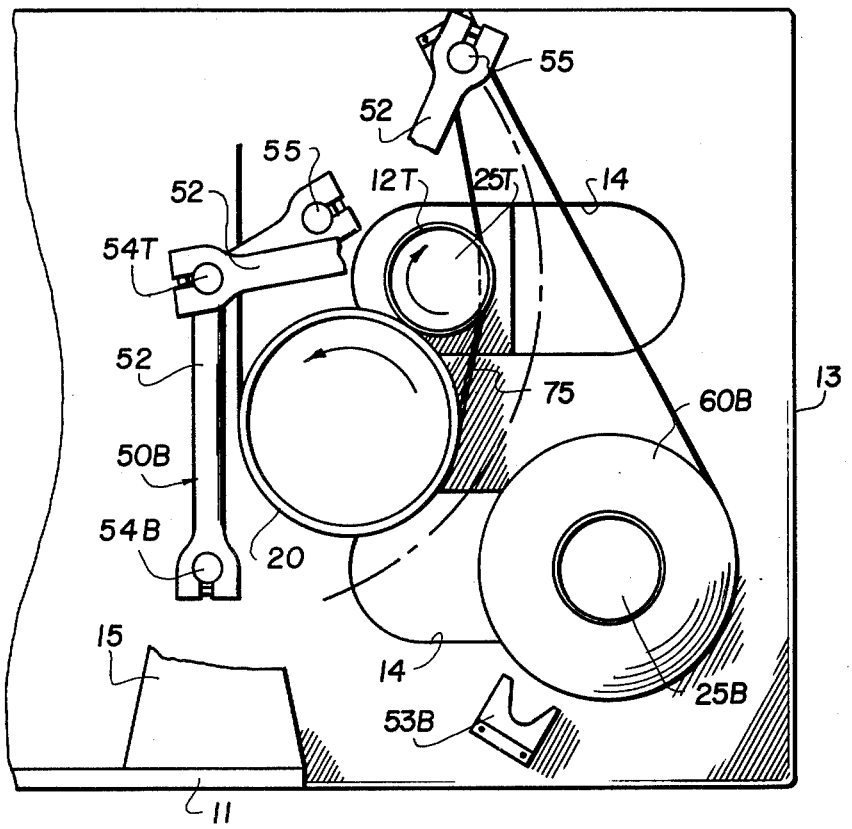
FIG. 2 is a view, similar to FIG. 1, illustrating the transfer of the yarn from a yarn package on the lower chuck to an empty bobbin on the upper chuck.
Figure 3:
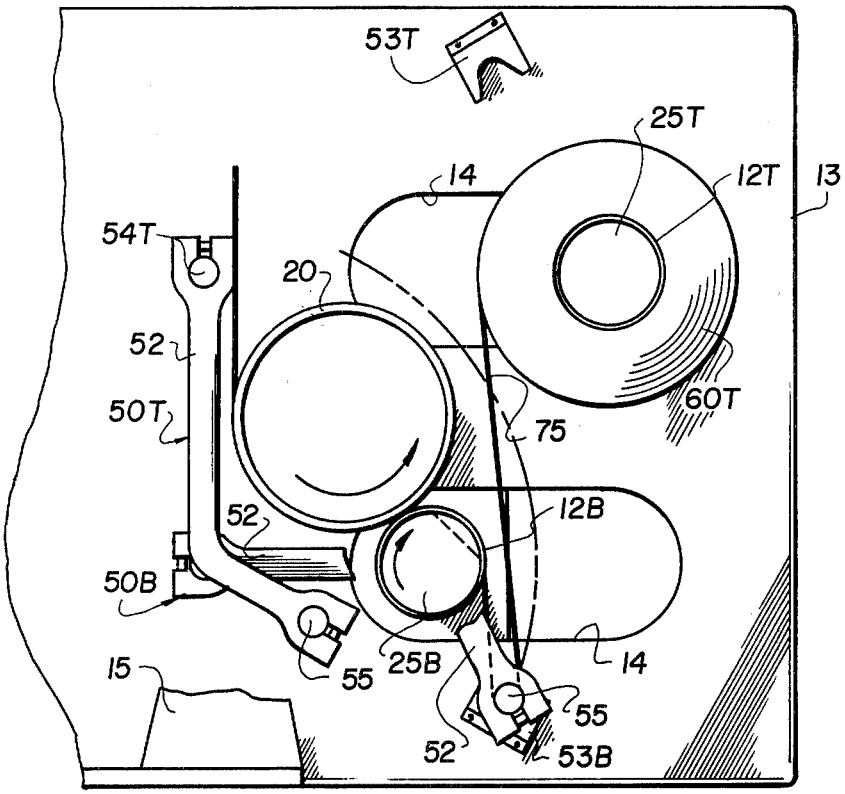
FIG. 3 is a view, similar to FIGS. 1 and 2, showing the transfer of yarn from a yarn package being wound on an upper chuck to an empty bobbin on a lower chuck.
Figure 5:
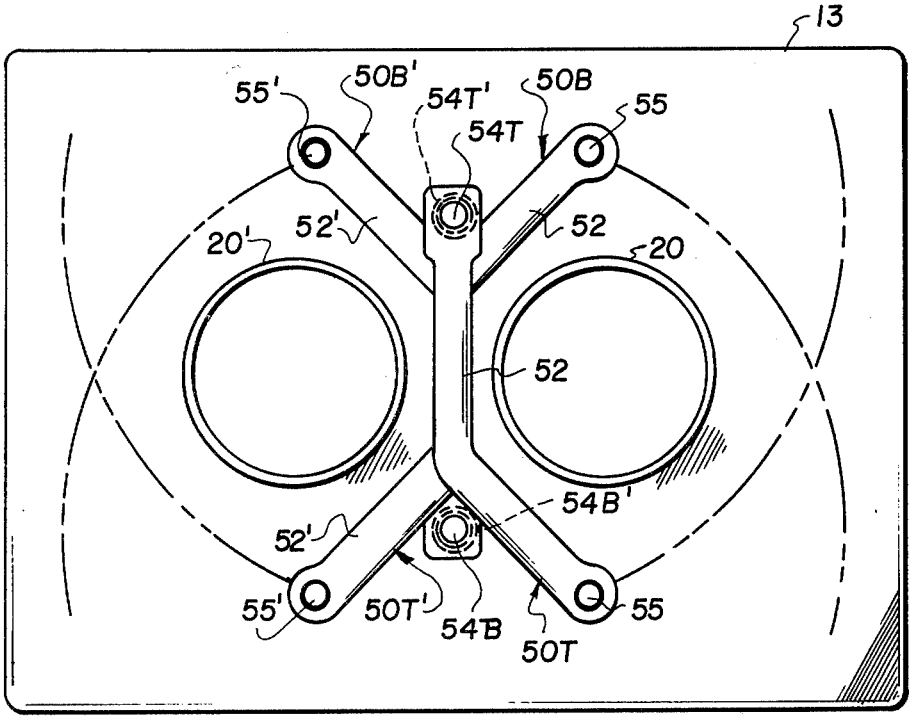
FIG. 5 is a front elevation of a yarn winder, embodying the invention, having pairs of upper and lower chucks on each side of a traverse housing.

Referring first to FIGS. 1, 2, 3, 5 and 7 of the drawing, a known 4-chuck yarn winder is generally indicated at 10 as including a base 11 and a housing for the winder mechanism. An upright front wall 13 extends upwardly from base 11 and closes the forward end of the housing, wall 13, for a purpose to be described, being formed with four oval slots 14. FIGS. 1, 2 and 3 show only the right hand half of the four-chuck yarn winder, as viewed from the front thereof, whereas FIG. 5 shows both halves of the winder.

A traverse housing and cam, generally indicated at 15, extends forwardly from wall 13 at substantially the center thereof and, in a known manner, is provided with traverse guides 16 which are reciprocated longitudinally of housing 15 for cross-winding yarn onto bobbins. Closely adjacent the opposite sides of traverse housing 15, there are two rotatable drive rolls 20, 20' each mounted on wall 13, and driven in a manner described more fully hereinafter. Each drive roll may be provided with one or more overdrive rings, such as known to those skilled in the art, operable to rotate a chuck, engaged therewith, at a higher speed than that at which the chuck would be rotated by a bobbin or package engaged with that part of the drive roll not provide with an overdrive ring.

In a known manner, winder 10 includes four rotatable chucks 25, ranged in pairs on opposite sides of traverse housing 15, with each pair including a top chuck, indicated at 25T, and a bottom chuck, indicated at 25B. By means of respective roller bearings or the like, chucks 25 are displaceable laterally of slots 14 between an inactive retracted position and an active position. In the active position, each chuck is engageable with a drive roll 20, it being noted that each pair of chucks, 25T and 25B, is associated with a respective drive roll 20. As the arrangement to the left of traverse housing 15 is the mirror image of that to the right of the traverse housing, only the arrangement to the right of the traverse housing will be described with respect to yarn transferring operation of the mechanism.

Figure 12:
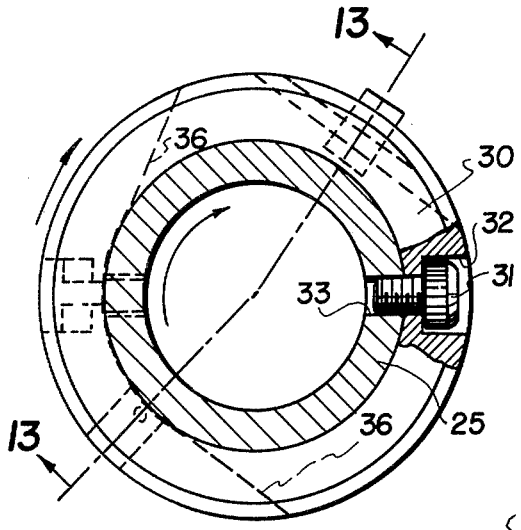
FIG. 12 is a diametric sectional view, corresponding to FIG. 11, illustrating the securing of the sleeve to a chuck.
Figure 13:
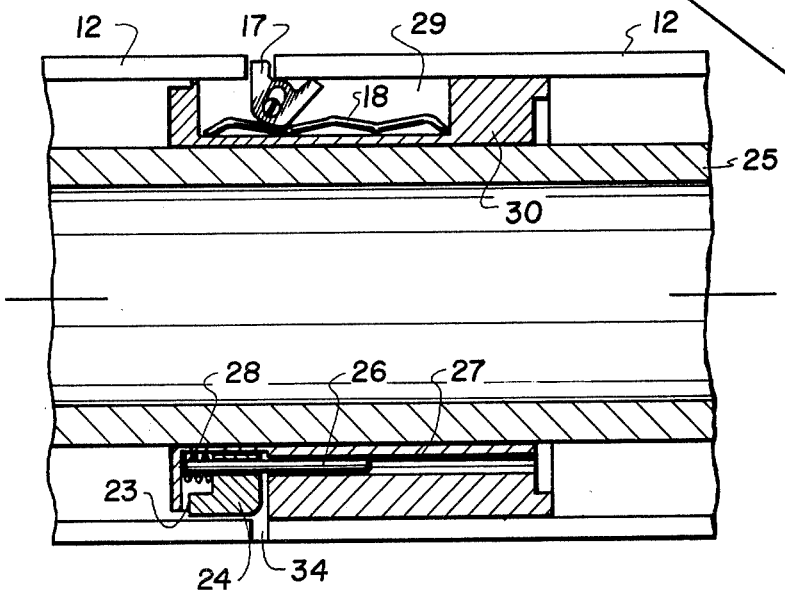
FIG. 13 is an axial sectional view of the chuck sleeve assembly illustrating the details of the yarn clamp.

Each chuck 25 has mounted thereon two or more sleeves 30 for mounting bobbins 35, there being one sleeve adjacent the "starting end" of each bobbin, and the number of sleeves being dependent upon the number of bobbins to be mounted on each chuck. Sleeves 30 are shown more in detail in FIGS. 11, 12 and 13. Referring to these figures, sleeve 30 is secured to a chuck 25 by bolts 31 received in recesses 32 in sleeve 30 and engaged in threaded bores 33 in chuck 25.

Figure 11:
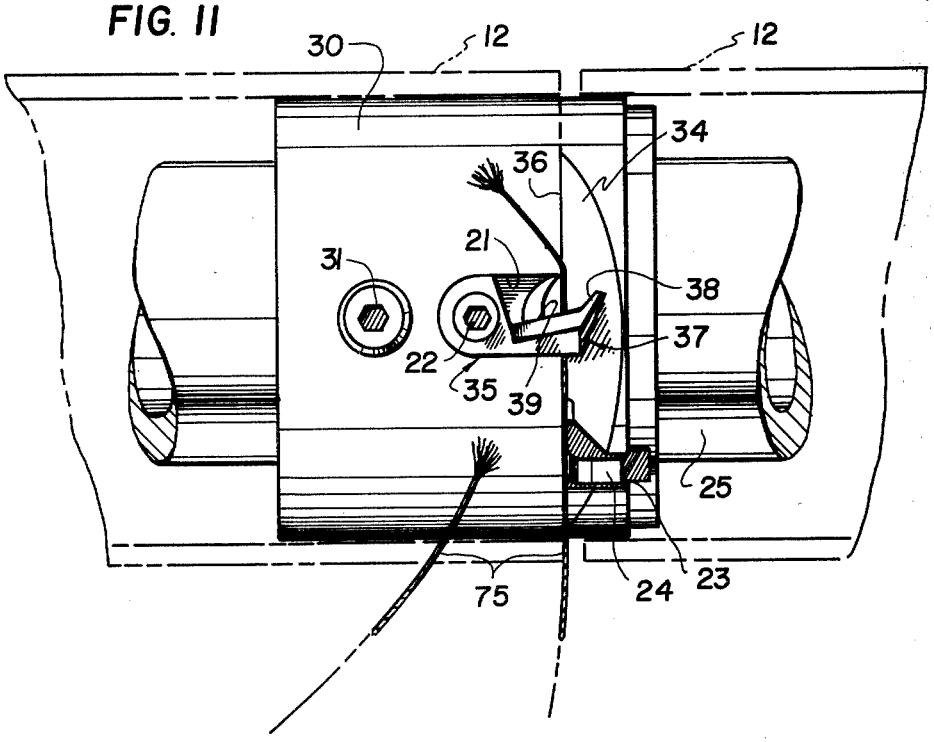
FIG. 11 is a plan vew of a chuck sleeve assembly, embodying the invention, illustrating a combined hook and yarn cutter and a yarn clamp.

Each sleeve 30, when used intermediate a pair of bobbins 12, is arranged to have both bobbins 12 telescope thereover with an axial spacing therebetween provided in a manner to be described. Adjacent one end of each sleeve 30, namely the end nearer the "starting end" of the left hand bobbin 12 as shown in FIG. 11, the sleeve is formed with a V-shaped groove 34 extending through a substantial arcuate extent of the sleeve 30 with its inner end extending substantially chordally of the sleeve, as indicated at 36 in FIG. 12. The outer surface of sleeve 30 is formed with a first recess 21 opening axially outwardly into groove 34 and receiving a combined yarn hook and yarn cutter 35 secured in position by a bolt 22 threaded into sleeve 30. A second recess 23, spaced angularly the recess 21, and "trailing" recess 21, considering the direction of rotation of chuck 25 and sleeve 30, receives a yarn clamp 24 shown more particularly in FIG. 13. Yarn clamp 35 is slidable on a rod 26 inserted in a bore 27 extending parallel to the axis of sleeve 30, and a spring 28 baises yarn clamp 24 across groove 34 to clamp a yarn engaged in the groove 34.

Combined yarn hook and cutter 35, as best seen in FIG. 11, includes an angular hook portion 37 projecting substantially into groove 34 and providing a first cutting edge 38 extending at an angle relative to the direction of rotation of sleeve 30, this cutting edge 38 being following by a second cutting edge 39 extending as shown, at an angle to the axis of sleeve 30. Consequently, when yarn is brought into alignment with groove 34, it is initially engaged with cutting edge 38 and slides therealong into engagement with cutting edge 39, so that the yarn, indicated as 75, is effectively severed. At the same time, that portion of the yarn being fed around the associated drive roll 20 is clamped by clamp 24, while the other portion of the yarn remains free to be wound about the nearly fully wound package. The cutting is greatly facilitated by the abrupt reversal of the direction of yarn movement, as can be determined from the arrows in FIGS. 2 and 3. The combined hook and cutter 35 thus forms a very effective means for catching and severing a yarn 75 to be wound onto an empty bobbin 12.

Sleeve 30 is provided with a further or third recess 29 for a known type of bobbin separator comprising a rocking member 17 engaging a wavy spring 18 seated in recess 29 and operating, in a known manner, to separate adjacent bobbins 12.

To effect the transfer of the yarn between a nearly full package or packages, being wound on a bobbin or bobbins on one chuck 25 of a pair, to an empty bobbin or bobbins, on the other chuck 25 of the pair, the transfer mechanism, in accordance with the invention, includes, for a winder having two pairs of chucks 25, one pair on each side of the traverse housing 15, right hand and left hand yarn pickups, generally indicated at 40 and 40', respectively, mounted on traverse housing 15, right and left hand yarn transfer means, generally indicated at 50 and 50', respectively, operatively associated with top chucks 25T, and right hand and left hand yarn transfer means, generally indicated at 50 and 50', operatively associated with the bottom chucks 25B. As the yarn pickups and the yarn transfer means on one side of traverse housing 15 are substantially identical with those on the opposite side of traverse housing 15, only those on the right hand side of traverse housing 15, as viewed in FIGS. 1, 2, 3 and 5, will be described in detail, with any differences between the pickups and the yarn transfer means on the right hand side and those on the left hand side being specifically mentioned.

Figure 7:
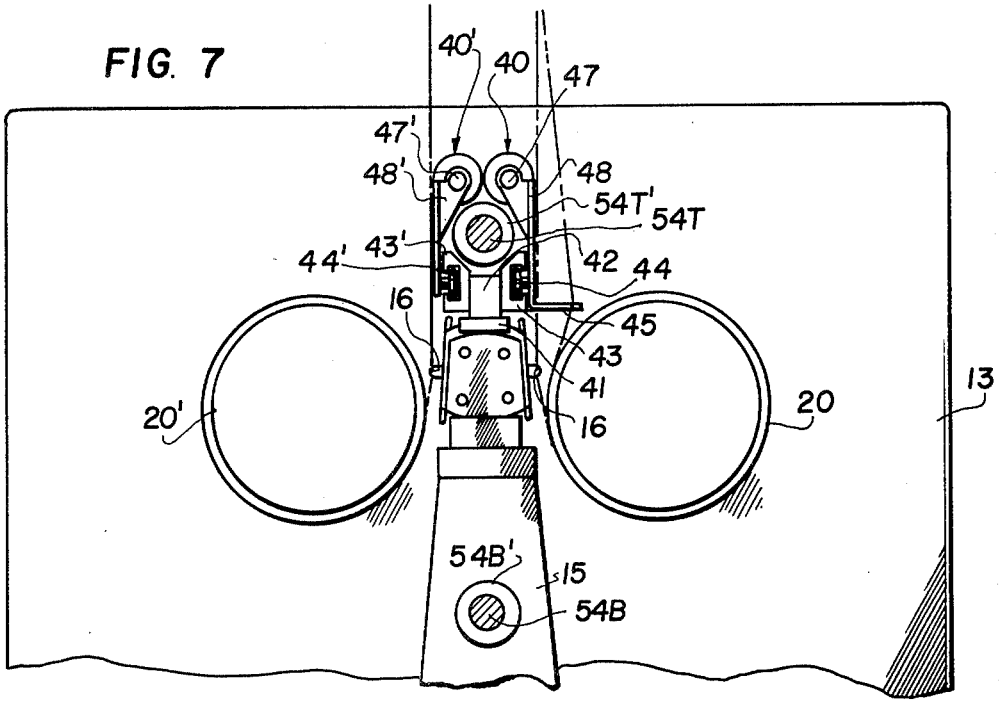
FIG. 7 is a front elevation view of the yarn winder illustrating the yarn pickup means.
Figure 8:
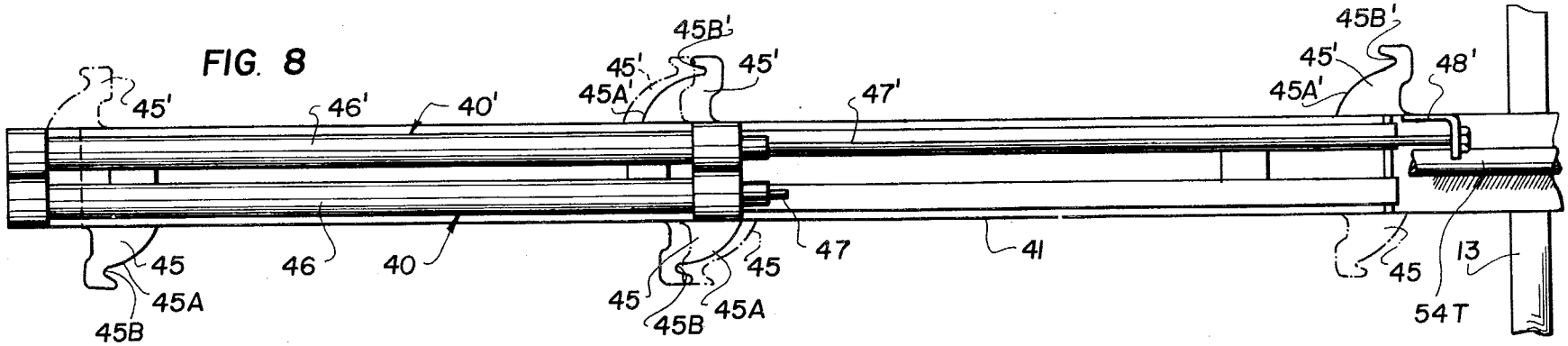
FIG. 8 is a top plan view corresponding to FIG. 7.
Figure 9:
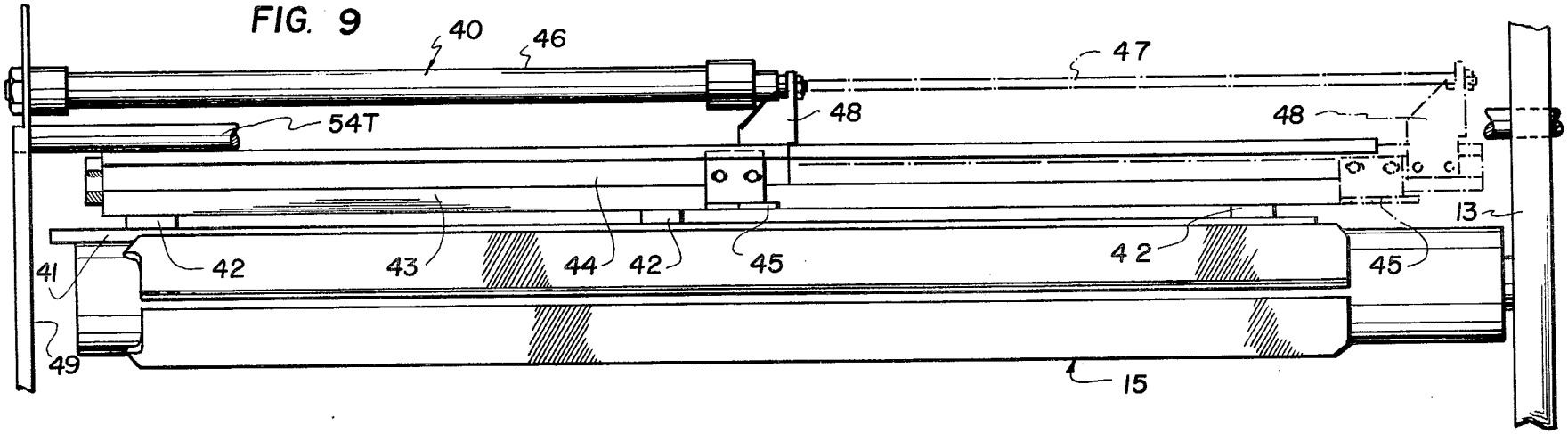
FIG. 9 is an elevation view, looking from the right of FIG. 7 and with the drive roll omitted.

Referring to FIGS. 7, 8 and 9, the yarn pickups 40 and 40' are mounted on a baseplate 41 secured on top of the traverse housing 15. Baseplate 41 has secured thereto upright rail brackets 42 to which are secured a right hand rail 43 and a left hand rail 43', which are generally C-shaped in cross-section and face outwardly. Each rail 43, 43' slidably mounts a respective slide 44, 44'. Each slide 44, 44' has secured thereto in longitudinally spaced relation therealong, a pair of yarn pickups 45. It should be noted that the yarn pickups 45 on the right hand side of the traverse housing face in one direction while the yarn pickups 45' on the left hand side of the traverse housing face in the opposite direction.

The pickups 45 and 45' project laterally outwardly a considerable distance from the respective slides 44 and 44'. Each pickup 45 has a convexly curved leading surface 45A terminating in a notch or a hook portion 45B, for a purpose to be described.

A plate-shaped bracket 49 is secured to traverse housing 15, in a manner not shown in detail, to extend upwardly above the rails 43 and 43'. Cylinders 46 and 46', which may be air operated or hydraulically operated, are secured at one end to plate bracket 49, and each cylinder has associated therewith a respective piston rod 47 and 47'. The outer ends of piston rods 47 and 47' are secured to push brackets 48 and 48', respectively, and these brackets, in turn, are secured to the respective slides 43 and 43'. In the inactive position of the yarn pickups 40 and 40', piston rod 47' is extended and piston rod 47 is retracted, as best seen in FIGS. 8 and 9.

When the yarn pickup 40, on the right hand side of traverse housing 15, is activated upon signal, cylinder 46 extends its piston rod 47 to advance yarn pickups 45 from the position shown in solid lines in FIGS. 8 and 9 to the position shown in dotted lines in these figures. During this operation, the yarn pickups 45 engage the yarn 75 being cross-wound through traverse guides 16, so that the yarn is moved outwardly along the surfaces 45A of yarn pickups 45, to disengage the yarn from the traverse guide 16, and into notches 45B. Reference is made to the right hand side of FIG. 7, which illustrates the yarn 75 as disengaged from the traverse guide 16 and engaged in the yarn pickup 45. At the end of the stroke of yarn pickup 40, the yarns 75 are at the "starting ends" of the two bobbins mounted on a chuck 25, and the yarns are no longer being cross-wound on the substantially full package, all of which will be explained in greater detail hereinafter. Similarly to the movement of the right hand yarn guide 40, the left hand yarn guide 40', upon signal, causes its cylinder 46' to retract its piston rod 47' with the yarn guides 45' to disengage the yarns from the traverse guide 16 on the left hand side of traverse housing 15, and to move these yarns outwardly and into engagement with the hook portions 45B' of the yarn guides 45'. Following transfer of yarn from a nearly full package to an empty bobbin, the yarn pickup devices 45 and 45' are moved in the reverse direction to release the yarns into the respective traverse guides 16 for cross winding of the new package or packages on the hitherto empty bobbin or bobbins.

Figure 10:
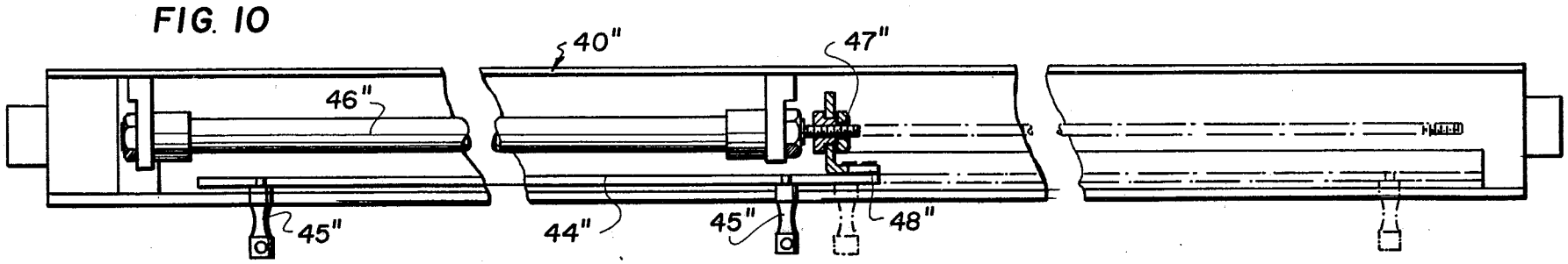
FIG. 10 is a plan view of a modified form of yarn pickup means.

FIG. 10 illustrates a modified form of yarn pickup 40" including, in the same manner as just described, an air or hydraulic cylinder 46" having a piston rod 47" secured by a push bracket 48" to a slide 44". Slide 44" carries modified yarn pickup elements 45" which, in this case, are in the form of spool shaped elements secured either fixedly or rotatably to slide 44". Yarn pickup 40" operates in the same manner as just described, and is mounted on traverse housing 15, there being two yarn pickups 40" in the event of a winder having pairs of chucks on both the left and right sides of traverse housing 15. Details of the mounting are omitted as the mounting is essentially the same as that previously described for yarn pickup 40.

The yarn transfer mechanism is illustrated in FIGS. 1, 2 and 3 which, however, show the yarn transfer mechanism on only one side of the winder for the purpose of simplifying the description of the yarn transfer mechanism. As mentioned, an important feature of the invention is the swinging of the yarn transfer rods or bars about axes which are spaced from the axes of the associated chucks toward the sides of the chucks remote from the transfer rods. This feature is of the greatest importance in assuring an effective "wrap around" of the yarn with respect to the associated chucks or the bobbins mounted thereon, while not requiring any increase in the space occupied by the yarn transfer mechanism. The yarn transfer mechanism includes two yarn transfer means, namely an "upper" yarn transfer means for transferring yarn from a nearly full package being wound on a bobbin on the lower chuck 25B to an empty bobbin mounted on the upper chuck 25T, and a "lower" yarn transfer means for transferring yarn from a substantially fully wound package on the upper chuck 25T to an empty bobbin on the lower chuck 25B. As the upper and lower yarn transfer means are substantially identical in construction, the same reference characters will be used for both transfer means and, where elements of one transfer means differ slightly from elements of the other transfer means, the element for the upper transfer means will be designated by the suffix T and that for the lower transfer means by the suffix B. Referring more particularly to FIGS. 1, 2 and 3, each yarn transfer means 50T and 50B includes a respective yarn transfer rod or bar extending substantially the full length of the chucks 25T and 25B. Each yarn transfer rod 55 is formed with notches 56 corresponding, in number, to the number of bobbins mounted on each chuck, with each notch 56 being substantially aligned with the groove 34 of a respective pickup portion 30 of the chucks. Each notch 56 is arranged to receive a yarn 75 moved into alignment therewith by a yarn pickup 40 or 40" which first removes the yarn from the traverse guide 16 and then shifts it axially into alignment with the associated notch 56. The notches 56 are arranged to guide the yarns, thus removed by the pusher or carrier 40 or 40" from the traverse guide 16, into alignment with the grooves 34 of the pickup portions of the associated chucks, and thereafter to release the yarns to the pusher or carrier 40 or 40" for reengagement thereby into the traverse guides 16 for winding of the new yarn package.

For this purpose, each rod 55 has a "front" end, remote from front wall 13 of the winder, secured, as by clamping, in the free end of an angle arm 52 secured, as by clamping, to a respective shaft 54T or 54B rotatably mounted and extending through traverse housing 15 or a support therefor, and through the front wall 13 of the winder. Each shaft 54 is arranged to be angularly displaced by a respective rotary actuator 51 mounted within the winder, as on the inner side of the front wall 13. However, and as previously mentioned, the shafts 54 may be angularly displaced, to swing the arms 55 about the axes of the respective shafts 54, by a stepping motor supplied from a variable frequency inverter.

FIG. 1 illustrates the yarn transfer means 50T and 50B in their "rest" or inactive positions, with a yarn package 60B being wound on a bobbin 12B on bottom chuck 25B, by the engagement of package 60B with drive roll 20. The yarn package 60B is substantially fully wound in FIG. 1. It will be noted that yarn 75 is fed downwardly and beneath drive roll 20 and then between drive roll 20 and yarn package 60B. Top chuck 25T, having one or more empty bobbins 12T thereon, is in its fully retracted position at the right hand end of its associated slot 64, and bottom chuck 25B mounting bobbin 12B with yarn package 60B being wound thereon is intermediate the ends of its associated slot 14 but nearer the retracted end thereof.

When yarn package 60B is substantially fully wound, a suitable signal is provided, as by sensing the outside diameter of the package, and this signal results in actuation of the upper transfer means 50T as shown more particularly in FIG. 2, and also in actuation of the yarn pickup 40 or 40" to displace the pickup elements 45 or 45" from the solid line positions to the dotted lines positions. This latter operation results in the yarns 75 being disengaged from the traverse guides 16 and moved axially of drive roll 20 so that the yarns are aligned with the notches 56 of the yarn transfer rod 55. At the same time, chuck 25B is displaced to the extreme right end of its slot 14 to be spaced from drive roll 20, while still rotating at a high speed due to its inertia. However, at this time, yarn 75 is no longer cross-wound on package 60B but is supplied linearly to the package 60B. Also, top chuck 25T is displaced to the left end of its slot 14 to engage empty bobbin 12T thereon with drive roll 20 for high speed rotation by the drive roll in the direction indicated by the arrow in FIG. 2. Responsive to the signal, the rotary actuator 51, or other drive means, for yarn transfer means 50T is activated to rotate shaft 54T to swing the yarn tranfer rod 55 through the space between drive roll 20 and package 25B, so that notches 56 engage and draw loops of yarn 75 and move these loops upwardly, in a counter-clockwise direction as viewed in FIG. 2, to engage the yarn 75 with the grooves 34 of the pickup sleeves 40 on top chuck 25T. It will be noted that this results in a substantial "wrap-around" of yarn 75 with respect to empty chuck 25T. The movement of transfer rod 55 is continued until the latter engages an upper stop or rest 53T.

As the yarns are caught in grooves 34, they are engaged by the combination cutter and hook 35 to slide along the inclined knife edge 38 and the knife edge 39 thereof for severing of the yarn, with the severing being being facilitated by the abrupt reversal of the direction of movement of yarns 75. The separate yarns are clamped by the respective yarn clamps 24. During this operation, and after yarn transfer rod 55 has moved through the space between drive roll 20 and yarn package 60B, chuck 25T is displaced again to the left, as viewed in FIG. 2, to engage package 60B with drive roll 20 for continued high speed winding of yarn 75 on package 60B to maintain full tension on the yarn during the transfer operation.

While all of the foregoing movements have been mentioned as taking place separately, it should be understood that movement of the several parts is effected nearly simultaneously and in a time of the order of a few milliseconds. Thus, the bobbin 12T is moved into engagement with drive roll 20 substantially simultaneously with retraction of yarn package 60B from the drive roll, and the transfer movement of transfer rod 55 occurs immediately as yarn package 60B is sufficiently displaced from drive roll 20. Yarn package 60B is moved back into engagement with drive roll 20 immediately after transfer rod 55 has passed between drive roll 20 and yarn package 60B.

After the yarn has been effectively caught on top chuck 25T for winding on bobbin 12T, the still rotating yarn package 60B is moved away from drive roll 20 and, if necessary, bottom chuck 25B is braked to a stop. The rotary actuator or other operating means 51 for upper yarn transfer means 50T is then actuated to swing yarn transfer rod 55 in the reverse direction and back to its position as shown in FIG. 1, and yarn pickup 40 or 40" engages the yarns 75 and is retracted from its dotted line position to its solid line position to reengage the yarns in the traverse guides 16. Winding of a new yarn package on bobbin 12T then continues.

FIG. 3 illustrates the operation of lower yarn transfer means 50B in transferring yarn 75 from a substantially full package 60T being wound on bobbin 12T on chuck 25T to an empty bobbin 12B on bottom chuck 25B. The sequence of operations is the same as that described with reference to FIG. 2 and to upper yarn transfer means 50. However, it will be noted that an even greater "wrap-around" on bottom chuck 25B is effected by lower yarn transfer means 50B. Again, the transfer of the yarn requires only a few milliseconds, and the tension on the yarn is maintained by bringing yarn package 60T back into engagement with drive roll 20 immediately after yarn transfer rod 55 of lower yarn transfer means 50B has passed between drive roll 20 and package 60B.

Figure 4:
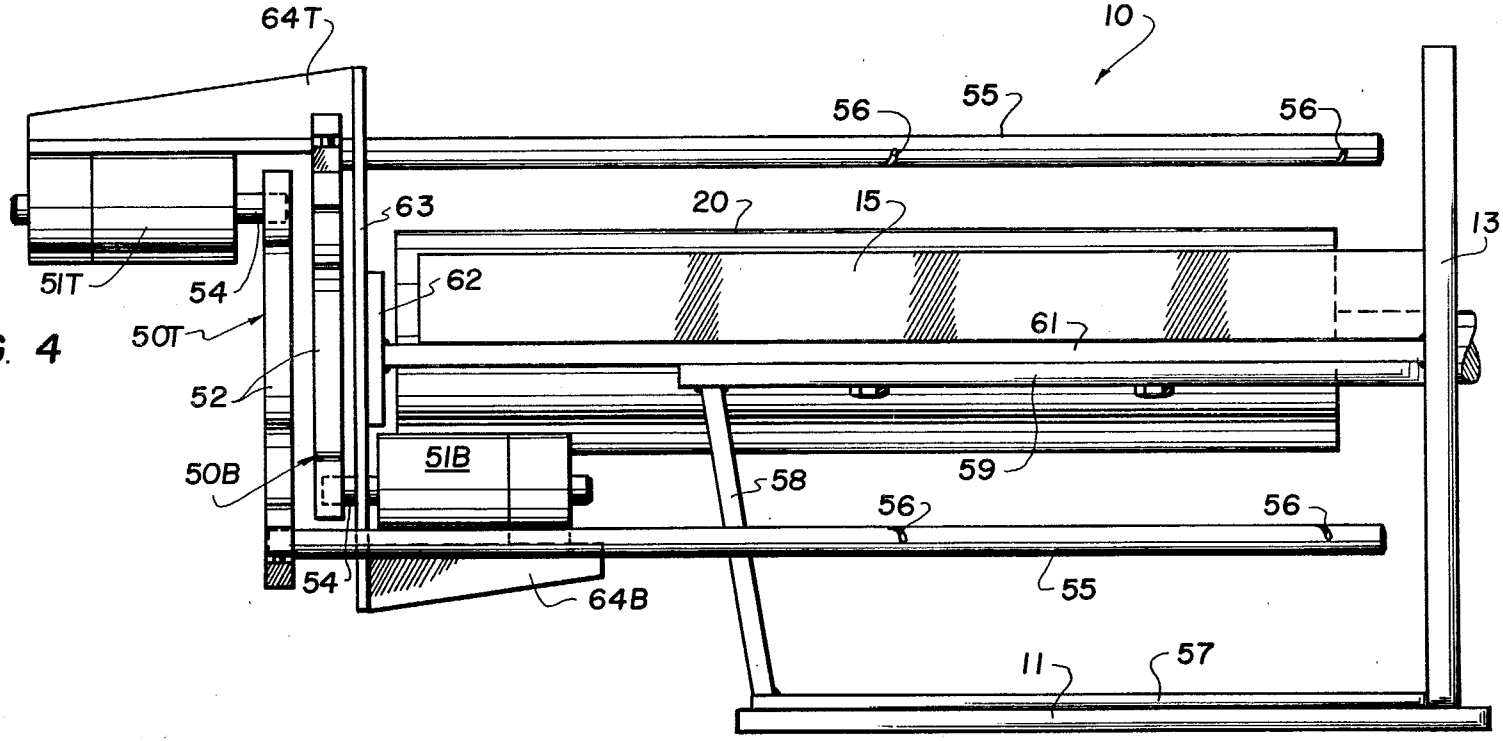
FIG. 4 is a side elevation view of the winder shown in FIGS. 1, 2 and 3.

FIG. 4 is a side elevation view, with parts omitted, illustrating the support for the transverse housing and also illustrating the yarn transfer mechanism as designed as an "adapter kit" for use on existing two chuck winders. Referring to FIG. 4, the support for the transverse housing includes a bottom plate 57 secured to base 11 of the winder and having a plate 58 extending upwardly at an angle therefrom. A top plate 59 is secured to the upper end of plate 58 and also to front wall 13 of the winder. To support the outer ends of the shafts 54, a baseplate 61 is bolted to top plate 59 and has secured, to its outer end, an upright relatively heavy plate 62 to which there is bolted or othewise secured a vertical outer wall member 63 through which the shafts 54 project outwardly, although this is not shown in FIG. 4 which otherwise is directed to the yarn transfer mechanism as a so-called "adapter kit".

In the "adapter kit", the rotary actuators 51T and 51B, instead of being mounted within the winder housing, as on front wall 13 thereof, are mounted on respective brackets 64 secured on outer wall member 63. Bracket 64T for supporting rotary actuator 51T extends outwardly from outer wall member 63, whereas bracket 64B for supporting rotary actuator 51B extends inwardly from outer wall member 63.

Figure 6:
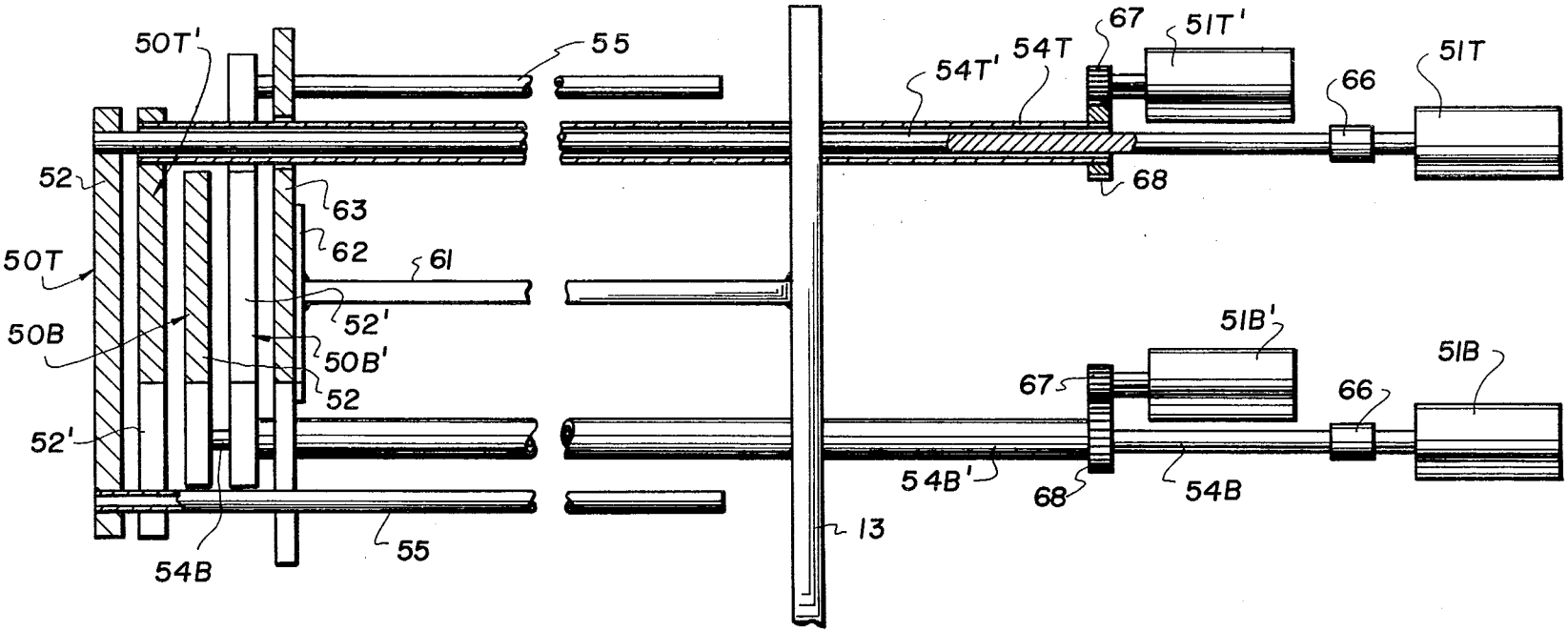
FIG. 6 is a side elevation view of the yarn winder shown in FIG. 5.

FIGS. 5 and 6 illustrate, with the omission of certain parts for clarity, the apparatus of the invention as applied to a winder having two pairs of chucks 25, one pair on each side of the traverse housing 15 and each associated with a respective drive roll 20, each pair including an upper chuck 25T and a lower chuck 25B. In FIGS. 5 and 6, the drive roll and the yarn transfer means on the right hand side of the winder, looking from the front, are designated with the same reference numerals as used in FIGS. 1–4, whereas the drive roll and the yarn transfer means on the left side of the traverse housing, as viewed from the front, are designated with the same reference characters primed.

As previously mentioned, in the embodiment of the invention shown in FIGS. 1, 2 and 3, the respective rotary actuators 51 are mounted within the housing of the winder, as by being mounted, for example, on the inner surface of the wall 13, with FIG. 4 illustrating an alternative arrangement which, as also mentioned, forms an adapter kit for addition to existing winders and which illustrates the rotary actuators as being mounted on the outer wall member 63 rather than within the housing of the winder. In the four-chuck arrangement shown in FIGS. 5 and 6, the rotary actuators 51 and 51' are also mounted within the housing of the winder, although the specific mounting arrangements have not been illustrated in FIGS. 5 and 6. As shown, rotary actuators 51T and 51B for respectively angularly displacing yarn transfer means 50T and 50B are connected to the respective shafts 54T and 54B through couplings illustrated at 66. The shafts 54T and 54B extend through respective tubular shafts 54T' and 54B' for swinging the left hand yarn transfer means 50T' and 50B', respectively, the shafts 54T' and 54B' having secured, to their outer ends, the respective arms 52'. Shafts 54T' and 54B' are rotated by respective rotary actuators, or other suitable drive means, indicated at 51T' and 51B'. Each actuator drives its associated shaft 54T' or 54B' through the medium of an output drive pinion 67 meshing with a gear 68 secured to the respective tubular shaft 54T' or 54B'. By virtue of the telescoping relation of the shafts 54 and 54', a compact arrangement is provided for a four-chuck winder. The respective yarn transfer means on the right hand side and on the left hand side of the traverse housing 15 may be controlled and operated independently of each other, with each yarn transfer means being associated with a respective yarn pickup 40 or 40' such as shown in FIGS. 7, 8, 9 and 10. As the operations of the respective yarn transfer means on the right hand and left hand sides are identical and operate in the same manner as described with respect to the embodiment of the invention shown in FIGS. 1, 2 and 3, it is believed that no further detailed description is necessary.

Figures 14, 15:
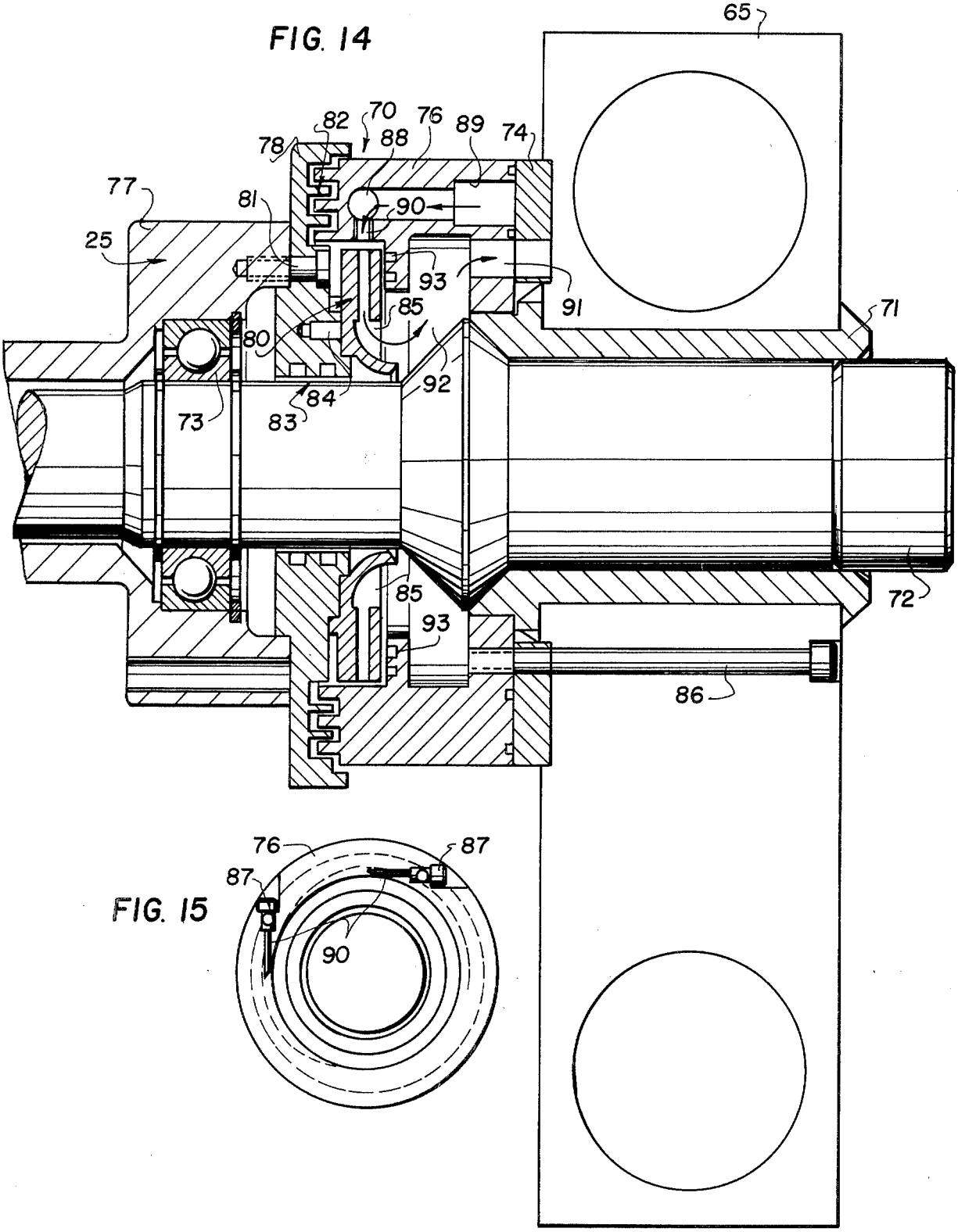
FIG. 14 is an axial sectional view of a turbine for rotating a chuck.
FIG. 15 is a diametric sectional view showing the rotor and injector of the turbine illustrated in FIG. 14.

As previously mentioned, the chucks 25, instead of being driven either by direct engagement with the drive rolls 20 or by engagement of a yarn package 60 thereon with a drive roll, may be independently driven or rotated by associated drive means such as a separate motor or a turbine. FIGS. 14 and 15 illustrate an air or hydraulically operated turbine for rotating a chuck 25.

Referring to these figures, the turbine, generally indicated at 70, the chuck 25, and associated elements are mounted in a chuck support 65 which may be displaceably mounted on housing front wall 13 for displacement of chuck 25 laterally of a slot 14 in the wall. Through the medium of a sleeve 71, chuck support 65 fixedly mounts a chuck shaft 72 which rotatably supports, through anti-friction bearings 73, of which one is illustrated in FIG. 14, the tubular chuck 25 for rotation by the turbine 70. Turbine 70 includes a manifold 74 secured, as by welding or brazing, to chuck support 65, and a turbine injector 76, constituting a casing for turbine 70, is fixedly secured to sleeve 71 and is in sealing engagement with manifold 74. The inner end of chuck 25 has an enlarged cylindrical portion 77 in which is mounted the anti-friction bearing 73, and a turbine seal 78 is bolted to enlargement 77 by bolts 81. Turbine seal 78 has a fluid-tight seal with turbine injector 76, as indicated at 82, and a fluid-tight seal with shaft 72, as indicated at 83. A turbine rotor 80 is secured to rotate with turbine seal 78 and with chuck 25, as by means of pins or bolts 84 engaged in bores of turbine seal 78. Turbine injector 76 is further secured against movement relative to chuck support 65 by bolts 86.

Turbine rotor 80 has vane passages 85 into which an operating fluid under pressure is injected by nozzle bores or passages 90 in turbine injector 76 and extending substantially tangentially to turbine rotor 85. The outer ends of the nozzle passages or bores are closed by suitable tight plugs 87 threaded thereinto. Nozzle passages or bores 90 communicate with an annular conduit 88 in turbine injector 76, and operating fluid under pressure is supplied to annular passage 88 through an inlet passage 89 communicating, through chuck support 65, with a source of suitable operating fluid under pressure. The exhaust fluid from rotor 80 and turbine 70 is discharged through an exhaust passage 91 communicating with the expansion space 92 of turbine 70. Turbine injector 76 is further provided with a seal 93 cooperable with turbine rotor 80.

Summarizing the operation of the invention, when a yarn package 60 on one chuck 25 of an associated pair of upper and lower chucks is nearly fully wound, a control signal is applied to the yarn transfer mechanism. This control signal results in the following operations:

1. The associated yarn pickup 40 is moved from its solid line position to its dotted line position so that the pickup means 45 disengage the yarns 75 from the traverse guides 16 and displace the yarn or yarns axially of the associated drive roller 20 to a position aligned with the notches 56 in the yarn transfer rod 55 associated with the chuck 25 carrying an empty bobbin 12.

2. The chuck 25 carrying the nearly full package 60 thereon is thus no longer cross-wound but the yarn is fed linearly thereto.

3. This chuck is then moved in its slot 14 away from the drive roll 20 a distance sufficient to allow the yarn transfer rod 55 of the yarn transfer means associated with the other chuck to be moved, by a shaft 54 and arm 52, in the space between the drive roll and the nearly full package to engage and draw a loop or loops of yarn 75.

4. The nearly full package is immediately moved back into engagement with the drive roll 20 for positive rotation thereof to maintain the tension on the yarn.

5. The yarn loop or loops are drawn toward and beyond the empty bobbin until the yarn transfer rod 55 engages its stop or rest 53.

6. This causes the yarn or yarns 75 of the drawn loop or loops to engage in the groove or grooves 34 of the chuck carrying the empty bobbin and to be caught by the hook or hooks 35 to be clamped by the clamping means 24 so that, and particularly because the direction of the arm movement is suddenly reversed, the yarn is severed by the cutting edges 38 and 39 of the hooks 35.

7. The full package is disengaged from the drive roll 20 and its supporting chuck is moved to the extreme outer end of the slot 14, and the yarn means 55 is disengaged from its seat or rest 53 and returned to its inactive position, shown in FIG. 1, by its shaft 54 and the arm 52, releasing the yarn 75 from its notches 56 with the yarns 75 being wound on the previously empty chuck 12.

8. Simultaneously, the associated yarn pickup 40 is retracted from its dotted line positions to a solid line position to release the yarns from its pickup means 45 to be reengaged in the traverse guides 16 for cross-winding of the yarn on the previously empty bobbin.

While all of the foregoing operations are set forth in sequence, to give a clear picture of the operation of the yarn transfer mechanism of the invention and the method of transferring yarn from a full package to an empty bobbin, it should be understood that certain of the above listed operations take place simultaneously with others thereof and the entire transfer operation occurs in a matter of milliseconds. Thus, the loss of yarn during the transfer operation, taking note that the yarn is fed at a very high speed, is at an absolute minimum so that there practically no waste of the yarn.

It will be noted that some "slack" in the yarns is necessary for the transfer mechanism to operate. This slack is provided, in the first instance, due to the fact that the yarns, when engaged in the transfer mechanism, are no longer being cross-wound on the full package 60, but are being fed linearly toward this package. Additional slack is provided by the very slight deceleration of the package 60 when momentarily disengaged from drive roll 20. This supplies sufficient slack for the high speed transfer operation.

Figure 16:
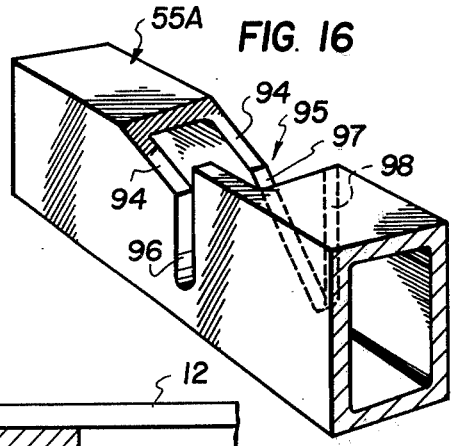
FIG. 16 is a perspective view, partly in section, of a transfer rod and illustrating the yarn-receiving slot therein.

FIG. 16 illustrates a preferred form of yarn transfer rod and a preferred form of the notch or grooves therein. Referring to FIG. 16, the yarn transfer rod 55A is formed of mechanical tubing having a rectangular cross-section which may be formed or provided, at its left end as viewed in FIG. 16, with a suitable trunnion or the like for securement in an arm 52. Each slot or notch, generally indicated at 95, is formed with a lead-in bevelled surface 94 extending at an angle of substantially 30° downwardly and inwardly into the rod 55A. On one side of rod 55A, sloping surface 94 terminates in a vertically extending notch 96. In the opposite side wall of the arm 55A, the sloping surface 94 is continued as a longer surface 97 extending downwardly and inwardly at an angle of substantially 45° to the upper surface of rod 55A and terminating at a vertical surface 98.

As the yarn 75 is moved along arm 55A, it initially slides on the 20° sloping surface 94 and then is engaged in the vertical notch 96, with the yarn on the other side of arm 55A moving along the 45° sloping surface 97 into engagement with the vertical surface 98. The yarn thus extends at somewhat of an angle across arm 55A. The yarn extending from the bottom of vertical notch 96 leads to the substantially fully wound package, while the yarn at the bottom of the sloping surface 97 and engaging the vertical wall 98 is aligned with the groove 34 in the chuck sleeve 30, or with a groove in a bobbin mounted on the chuck. The arrangement of FIG. 16 assures accurate alignment of the yarn with the chuck or bobbin groove into which it is to be engaged.

While specific embodiments of the invention have been shown and described in detail to illustrate the application of principles of the invention, it should be understood that the invention may be embodied otherwise without departing from these principles.

What is claimed is:

1. A method of transferring a yarn or the like, being cross-wound by traverse means into a yarn package, on a substantially full bobbin mounted on a first chuck, and rotated at high speed by a drive roll with the yarn passing between the drive roll and the yarn package, to an empty bobbin, mounted on a second chuck arranged in spaced parallel relation to the first chuck, and initially disengaged from the drive roll, without loss of yarn speed and tension and with little or no waste of yarn, said method comprising the steps of engaging the empty bobbin with the drive roll for high rotation by the drive roll; moving the substantially completed yarn package, still rotating at a high speed, out of engagement with the drive roll to leave a space, between the yarn package and the drive roll, traversed by the yarn; engaging the yarn traversing such space to draw a loop of yarn toward the empty bobbin; while the loop is being drawn, reengaging the yarn package with the drive roll for continued rotation at high speed by the drive roll to maintain tension on the loop of yarn being drawn; disengaging the yarn from the traverse means to interrupt said cross-winding for linear feeding of the yarn to the yarn package rotated at a high speed, while drawing the yarn loop against and beyond the empty bobbin; guiding the yarn loop, while thus being drawn, axially of the empty bobbin and into alignment with the starting end of the empty bobbin, for catching and severing of the yarn being fed to the completed yarn package and winding of the yarn on the empty bobbin; and reengaging the yarn in the traverse means for cross-winding of a new yarn package on the previously empty bobbin.

2. A method, as claimed in claim 1, including moving the yarn package away from the drive roll for removal of the package from the first chuck and mounting of an empty bobbin on the first chuck for transfer of the yarn thereto following substantial completion of the winding of such new yarn package.

3. A method, as claimed in claim 1, in which severing of the yarn is effected by cutting of the yarn caught in the starting end of the empty bobbin assisted by the increase in yarn tension due to the reversal of yarn feed direction upon catching of the yarn in such starting end of the empty bobbin.

4. A method, as claimed in claim 1, in which the step of engaging the yarn traversing such space and drawing a loop of the yarn into engagement with the starting end of the empty bobbin is effected by providing an elongated element extending, substantially parallel to the chucks, throughout substantially the full length of the chucks; and swinging such elongated element about an axis spaced laterally a substantial distance from the axis of the first chuck in the direction of and beyond the drive roll, to engage the yarn traversing such space and move the yarn into engagement with the starting end of the empty bobbin.

5. A method, as claimed in claim 4, including the step of providing a second elongated element extending, substantially parallel to the chucks, through substantially the full length of the chucks; and swinging said second elongated element about an axis spaced laterally a substantial distance from the axis of the second chuck and beyond the drive roll, for transfer of yarn, being wound on the bobbin on the second chuck, to an empty bobbin on the first chuck.

6. A method, as claimed in claim 5, in which said traverse means comprises a traverse housing on the opposite side of the drive roll from the first and second chucks; said swinging axes of said first-mentioned and second elongated elements extending substantially centrally of the traverse housing.

7. Apparatus for transferring a yarn or the like, being cross-wound at a high speed onto a yarn package on a substantially full bobbin to an empty bobbin rotated at a high speed, without loss of yarn speed and tension and with substantially no loss of yarn, said apparatus comprising, in combination, means rotatably mounting said bobbins in spaced parallel relation to each other; a drive roll operable to rotate said bobbins when engaged therewith or with a yarn package being wound thereon; said empty bobbin initially being disengaged from said drive roll while said yarn package is engaged by said drive roll for rotation of said yarn package at such high speed, with the yarn being fed between said drive roll and the yarn package; traverse means cross-winding the yarn fed to said substantially full bobbin to form the yarn package theron; yarn gripping means adjacent the starting end of each bobbin; respective yarn transfer means operatively associated with each bobbin and each including an elongated yarn-engaging element extending parallel to substantially the full length of the associated bobbin; each yarn-engaging element having yarn guide means aligned with the starting end of an associated empty bobbin; first means operable, responsive to the yarn package on said full bobbin obtaining a pre-determined size, to engage said empty bobbin with said drive roll for rotation thereof at at least said high speed; second means operable, responsive to said empty bobbin attaining at least such high speed, to displace said substantially full bobbin, while rotating at a high speed, laterally away from said drive roll to provide a space between the yarn package on said substantially full bobbin and said drive roll; pickup means movable, from an inactive position in a direction parallel to said bobbins to engage the yarn and disengage the yarn from said traverse means, to interrupt such cross-winding for linear feeding of the yarn across such space to the yarn package still rotating at a high speed, and to move the yarn axially of said bobbins into alignment with the yarn guide means on said elongated yarn-engaging elements; operating means operable to displace said pickup means; third means operable, responsive to displacement of the yarn package out of engagement with said drive roll, to move the yarn transfer means associated with the empty bobbin from its retracted position to move its yarn engaging element through such space between said substantially full bobbin and said drive roll and toward said empty bobbin to engage the yarn being fed across such space to draw a loop of yarn toward and past the empty bobbin and into engagement with said yarn gripping means associated with said empty bobbin; said second means, immediately following passage of the yarn transfer means through such space, reengaging the yarn package with said drive roll to maintain full tension on the yarn loop being drawn; said yarn gripping means associated with said empty bobbin severing the gripped yarn for winding at high speed on said empty bobbin; said second means again retracting the yarn package from said drive roll and said third means returning the yarn transfer means to its retracted position through the resultant space between the yarn package and said drive roll; said operating means displacing said pickup means to its inactive position to release the yarn, previously engaged thereby, into said traverse means for cross-winding of a new yarn package on said empty bobbin.

8. Apparatus for transferring yarn or the like, as claimed in claim 7, in which each yarn transfer means includes an arm mounting, at a free end thereof, its associated elongated yarn-engaging element; a respective shaft to which the opposite end of each yarn engaging element is secured and forming an axis for rotation of the associated arm; each shaft extending parallel to the associated bobbin but being spaced therefrom beyond said drive roll; said third means comrising respective drive means for each shaft and operable to rotate the shaft through a pre-selected angle to effect movement of the associated yarn-engaging element from said retracted position to a position beyond the associated bobbin.

9. Apparatus for transferring yarn or the like, as claimed in claim 8, in which said traverse means includes a traverse housing extending parallel to said drive roll on the side of said drive roll remote from said bobbins; said shafts being rotatably mounted in said traverse housing and extending substantially centrally thereof; said traverse housing forming part of a winder including a housing having a front wall from which said traverse housing extends outwardly; said means rotatably mounting said bobbins in spaced parallel relation to each other comprising respective rotatable chucks each extending outwardly from said front wall and mounted for displacement toward and away from said drive roll; said chucks comprising a top chuck and a bottom chuck; said first and second means being operable to displace the respective chucks toward and away from said drive roll.

10. Apparatus for transferring a yarn or the like, as claimed in claim 9, in which said pickup means is mounted on said traverse housing for displacement longitudinally thereof in disengaging yarn from said traverse means and releasing yarn to said traverse means.

11. Apparatus for transferring a yarn or the like, as claimed in claim 8, in which said winder includes two pairs of chucks projecting forwardly from said front wall, one pair on each side of said traverse housing, and two pairs of yarn transfer means each associated with a respective chuck and each including an elongated yarn-engaging element extending parallel to substantially the full length of the associated chuck, a respective arm having the yarn-engaging element mounted at the free end thereof, and a respective shaft to which the opposite end of the arm is secured; respective means secured to each shaft to rotate the same; the shafts for the yarn transfer means on one side of said traverse housing comprising tubular shafts rotatably mounted in said traverse housing and extending substantially centrally therethrough, and the shafts for the yarn transfer means mounted on the opposite side of said traverse housing being telescoped through said tubular shafts and projecting therebeyond at each end.

12. Apparatus for transferring a yarn or the like, as claimed in claim 11, in which said third means comprises respective rotary actuators in the winder housing in driving engagement with the inner ends of said shafts.

13. Apparatus for transferring a yarn or the like, as claimed in claim 9, including respective stops mounted on said housing front wall and engageable with said elongated yarn-engaging elements at their limit of movement away from said retracted position.

14. Apparatus for transferring a yarn or the like, as claimed in claim 9, in which each yarn gripping means comprises a groove extending circumferentially of the associated chuck; a hook mounted on the associated chuck and projecting into said groove to catch the drawn loop of yarn and to sever the yarn by virtue of the yarn tension and the reversal of direction of the yarn; and a clamp extending into said groove upstream of said hook, considered in the direction of rotation of the chuck, to clamp the severed yarn.

15. Apparatus for transferring a yarn or the like, as claimed in claim 14, in which each hook is formed with the yarn cutting edge engageable with the drawn yarn loop.

16. Apparatus for transferring a yarn or the like, as claimed in claim 7, in which said operating means operable to displace said pickup means comprises a fluid pressure-operated linear actuator.

17. Apparatus for transferring a yarn or the like, as claimed in claim 7, in which said operating means operable to displace said pickup means comprises an inverter connected to source of direct current and a stepping motor connected to said inverter.

18. Apparatus for transferring a yarn or the like, as claimed in claim 7, in which said means rotatably mounting said bobbins in spaced parallel relation to each other comprises respective chucks; and respective fluid pressure-operated turbines connected to each chuck to rotate the same.

19. Apparatus for transferring a yarn or the like, as claimed in claim 7, in which said apparatus constitutes an adapter kit for use with already-constructed yarn winders each including a winder housing having an upright front wall and a traverse housing extending forwardly from the upright front wall and including a horizontal base and an elevated horizontal plate supported on said base; said apparatus comprising an elongated base plate disengageably securable to said elevated horizontal plate; a vertical wall plate secured, intermediate its ends, to the outer end of said elongated base plate; an upper bracket secured to said wall plate at the upper end thereof and extending outwardly therefrom; a lower bracket secured to said wall plate at the lower end thereof and extending inwardly therefrom; respective rotary actuators mounted on said brackets and each having a respective output shaft; each yarn transfer means comprising an arm secured at one end to a respective shaft and having secured to its opposite free end the associated elongated yarn-engaging element to extend inwardly thereof toward the inner wall of the winder housing.

20. Apparatus for transferring a yarn or the like, as claimed in claim 7, in which said traverse means comprises an elongated traverse housing and yarn guides reciprocable longitudinally of said housing; said pickup means comprising an elongated base plate secured on top of said traverse housing to extend longitudinally thereof, rail brackets secured to said elongated base plate to extend upwardly therefrom, rail means secured to said rail brackets, slide means engaged in said rail means for reciprocation longitudinally thereof, at least one pickup secured to said slide means thereof and formed to engage a yarn in a traverse guide and to disengage the yarn from the traverse guide upon movement of said slide means from an inactive retracted position, a fluid pressure-operated cylinder fixed with respect to said elongated base plate, and a piston rod associated with said cylinder and connected to said slide means to reciprocate said slide means; each pickup having an outwardly extending convex surface arranged to engage a yarn and followed by a hook portion arranged to hook the yarn disengaged from the traverse guide.

21. Apparatus for transferring a yarn or the like, as claimed in claim 7, in which the traverse means comprises an elongated traverse housing and yarn guides reciprocable longitudinally of said housing; said pickup means comprising an elongated channel member secured to said traverse housing to extend longitudinally thereof; a fluid pressure-operated linear actuator secured in said channel and including a cylinder and a piston rod extending from said cylinder; elongated slide means secured to said piston rod and disposed adjacent a flange of said cylinder; and spool-shaped pickup means secured to said slide and projecting laterally outwardly therefrom to engage yarn in the traverse guides and disengage the yarn from the traverse guides.

* * * * *